US005444947A

United States Patent [19]

Miller

[11] Patent Number: 5,444,947

[45] Date of Patent: Aug. 29, 1995

[54] FOUNDATION VENT

[75] Inventor: Barry K. Miller, Seattle, Wash.

[73] Assignee: Noll Manufacturing Co., Richmond, Calif.

[21] Appl. No.: 15,605

[22] Filed: Feb. 9, 1993

[51] Int. Cl.[6] ..... E04G 15/00; E04G 21/14

[52] U.S. Cl. ..... 52/100; 52/302.1; 52/577; 52/745.15; 249/39; 264/35; 454/271

[58] Field of Search ..... 52/576, 577, 99, 100, 52/302.1, 745.09, 745.15, 745.16, 743, 204.53, 204.54, 220.8, 98; 249/37, 38, 39; 454/243, 270, 271, 276; 264/35

[56] References Cited

U.S. PATENT DOCUMENTS

| | | | |
|---|---|---|---|
| Re. 17,164 | 12/1928 | Miller . | |
| D. 258,985 | 4/1981 | Peirce et al. . | |
| D. 259,277 | 5/1981 | McDermott . | |
| D. 259,736 | 6/1981 | Peirce et al. . | |
| D. 260,117 | 8/1981 | Peirce et al. . | |
| D. 269,293 | 6/1983 | Peirce et al. . | |
| D. 269,700 | 7/1983 | Peirce et al. . | |
| 290,084 | 12/1883 | Maxfield . | |
| D. 321,557 | 11/1991 | Bezick et al. . | |
| 512,440 | 1/1894 | Haustein . | |
| 1,613,047 | 1/1927 | Miller . | |
| 1,623,151 | 4/1927 | Wustholz . | |
| 1,645,419 | 10/1927 | Fox . | |
| 1,692,775 | 11/1928 | Hart . | |
| 1,764,343 | 6/1930 | Petrelli . | |
| 2,902,727 | 9/1959 | Samolis | 52/204.54 |
| 3,220,079 | 11/1965 | Aggson . | |
| 4,026,082 | 5/1977 | Crofoot . | |
| 4,138,084 | 2/1979 | Reid . | |
| 4,589,624 | 5/1986 | Jones | 249/39 |
| 4,951,914 | 8/1990 | Meyers et al. | 249/39 |

FOREIGN PATENT DOCUMENTS

| | | | |
|---|---|---|---|
| 911523 | 3/1946 | France | 249/39 |

*Primary Examiner*—Michael Safavi

*Attorney, Agent, or Firm*—Christensen, O'Connor, Johnson & Kindness

[57] ABSTRACT

A foundation vent (20) for use with concrete forms (31) is disclosed. The vent includes two frames that telescope together into a plurality of locking positions to allow the width of the vent to be changed to match the thickness of the concrete wall. The first frame (26) includes first walls (34) and a first flange (40). The first frame has a first inner end (36), and a first outer end (38). The first flange is disposed around a perimeter of the first outer end. The second frame (28) includes second walls (60) and a second flange (70). The second frame has a second inner end (66), and a second outer end (68). The second flange is disposed around a perimeter of the second outer end. A ridge (74) engages in channels (52, 58) defined by a plurality of shoulders (50, 54) disposed on the frames to allow the two frames to telescope together and to lock at various, predetermined widths. The ridge is disposed around a perimeter of the second inner end of the second frame. The ridge thus engages one of the channels. The foundation vent is used by locking the frames together to form the desired width, securing the vent between the concrete forms in a desired location, pouring the concrete between the forms around at least a portion of the vent. After the concrete cures, the forms are removed, tearing away breakaway portions on the flanges, leaving the foundation vent mounted in the concrete foundation.

8 Claims, 9 Drawing Sheets

FOUNDATION VENT

FIELD OF THE INVENTION

This invention relates generally to an apparatus and method for defining openings in concrete walls when formed, and more particularly, to an apparatus and method for using frames to form foundation vents.

BACKGROUND OF THE INVENTION

Customarily, vents in concrete walls were framed in connection with concrete wall forms so that when the concrete is poured and the forms removed, a vent aperture remains in the concrete. Vent frames have been developed to provide for construction of the vent aperture. There are several advantages to using a vent frame. For example, some vent frames allow screens or doors to be attached; others have a flared shape to channel water to the outside of the vent. In most cases, the foundation vent opening is easier to form with a vent frame.

Despite the advantages of vent frames currently used, some problems persist. For example, foundations are generally constructed with either a six-inch or an eight-inch thickness. However, with the current foundation vent frames, a different frame size must be used to accommodate each foundation thickness. Problems also persist with attachment of the vent frame to the panels or boards used to form the concrete and subsequent removal of the panels or boards from the vent frame. A foundation vent frame must be positioned accurately and the forms must be removable from the frame after the cement has cured.

One example of a prior art foundation vent frame is disclosed in U.S. Pat. No. 4,026,082 (Crofoot). The patent describes two identical frame structures that can be connected in a back-to-back relationship to form a single vent with walls that flare out from a juncture between the two frames. A screen may also be attached in the juncture between the two frames. The vent, however, only accommodates foundations of a single thickness. Different size frames must be manufactured depending on the thickness of the foundation wall into which the frame is to be disposed. Also, the methods the patent discloses for attachment of the frame to the forms (i.e., nailing the flanges of the frame to the forms or "supporting the frame on form ties") may not be easily carried out (see col. 3, lines 1–3). The "hard, stiff, plastic material" of which the vent is made can break while having a nail driven through it (see Col. 2, lines 40–42). Also, removal of the forms can be difficult without breaking the vent if the vent was nailed into place. Alternatively, supporting the vent on form ties may make accurate positioning and tight securing of the vent difficult.

A foundation vent box is also disclosed in U.S. Pat. No. 3,220,079 (Aggson). Aggson utilizes a two-piece vent that runs through a foundation. However, only one section of the vent spans the thickness of the foundation, leaving the other piece to simply cap the outside end of the vent with a removable vent screen. Due to a flexible flange portion, the vent box accommodates slight variations in distance between form panels. However, the purpose of the flexible flange is only to provide a constant engagement with the panels so as to preclude any passage of concrete therethrough. The vent does not accommodate radical changes in foundation wall thickness (e.g., six inches vs. eight inches). As with the Crofoot vent, the fastening of this vent into place between the forms and the removal of the forms can be difficult. The heads of nails driven through the flange may be embedded in cured concrete, making it difficult to pull the nails in order to remove the form.

Ventilator frames, not for use in forming foundation vents, have been developed that allow for variations in the thickness of a wall, floor, or ceiling. For example, a "ventilator thimble" is disclosed in U.S. Pat. No. 1,764,343 (Petrelli). The ventilator thimble includes telescoping sleeve structure that is biased to a collapsed position. The sleeves that comprise the sleeve structure have lips to avoid complete separation, but they do not lock into place at discrete widths. In fact, the object of the invention is to provide a ventilator that self-adjusts to the width between the ceiling of one room and the floor of a room above, being designed to mount in the space between the ceiling and the floor.

In consideration of the limitations and disadvantages of the devices and methods currently in use, it should be apparent that an effective solution to the problem of forming a foundation vent with a vent frame that can be used with foundations of various thicknesses and can be easily separated from concrete forms is not provided in the known prior art. Accordingly, the present invention was developed, and it provides significant advantages over previous devices or methods used to form foundation vents.

SUMMARY OF THE INVENTION

In accordance with this invention, a foundation vent to be used when forming concrete with forms is disclosed. The vent includes two frames that telescope together into a plurality of locking positions to allow the width of the vent to be changed depending on the thickness of the concrete to be formed. The first frame includes a first rigid body and a first flange. The first rigid body has a first inner end and a first outer end. The first flange is disposed around a perimeter of the first outer end. The second frame includes a second rigid body and a second flange. The second rigid body has a second inner end and a second outer end. The second flange is disposed around a perimeter of the second outer end. At least one ridge and a plurality of shoulders disposed on the frames allow the vent to be locked into various predetermined widths. At least one ridge is disposed around a perimeter of the inner end of the second frame. A plurality of shoulders forming a plurality of channels are disposed around the first rigid body of the first frame. The ridge is thus able to cooperatively engage any one of the channels. The foundation vent is used by locking the frames together to form the desired width (i.e., the width of the vent that would match the thickness of the foundation wall), securing the vent between the concrete forms in a desired location, pouring the concrete between the forms around the vent and allowing it to cure, and removing the forms, leaving the concrete foundation with the foundation vent.

In accordance with a particular preferred aspect of this invention, the first frame and second frame have parallelepiped shapes. The ridge runs around the inside of the inner end of the second frame in a plane parallel to a plane containing the second flange. The channels run around the outside of the walls of the first frame parallel to the first flange. Thereby, when the ridge interlocks with one of the channels, the first flange and the second flange are disposed in parallel planes.

In accordance with another aspect of this invention, the first flange and the second flange have attachment portions for securing the vent to the forms. The attachment portions comprise breakaway sections. The breakaway sections hold the frames in place while the concrete is being formed and cured, but when the forms are pulled away from the concrete, the breakaway sections break away from the flanges without damaging other portions of the flanges or frames.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
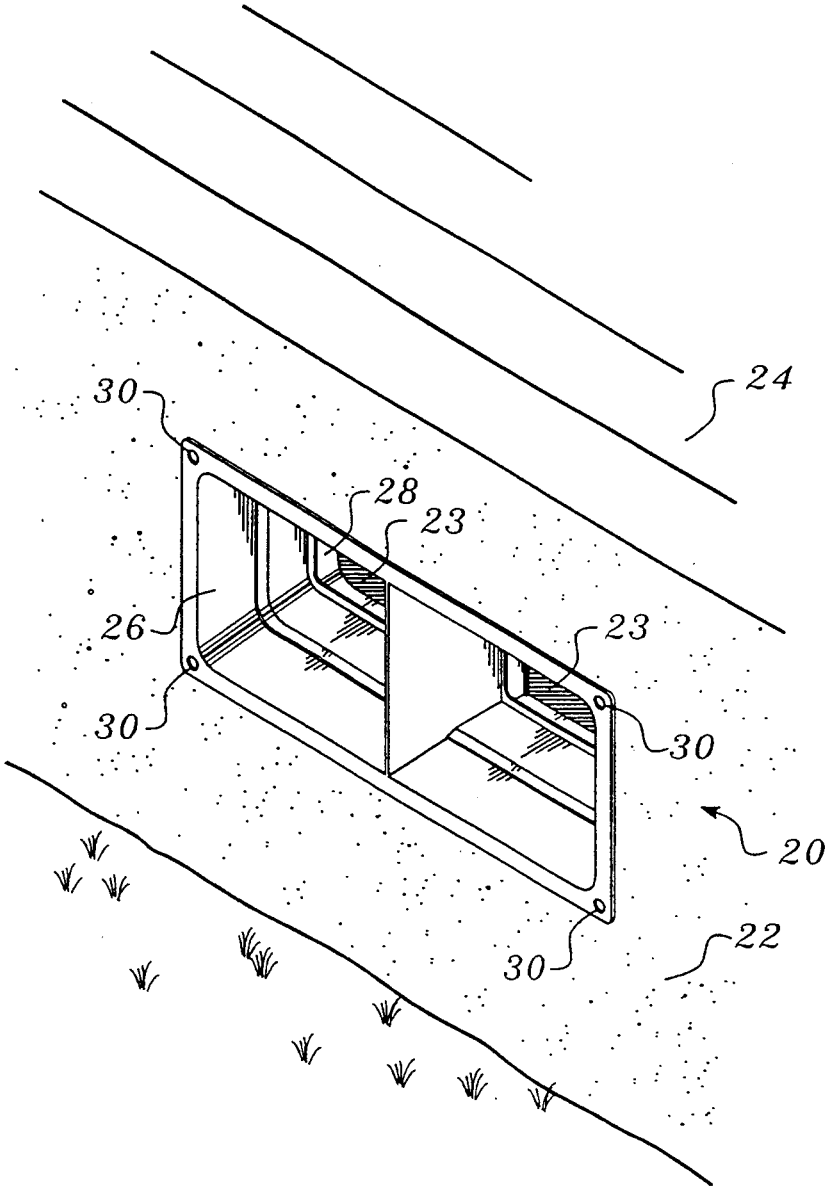
FIG. 1 is a perspective view of the invention, illustrating the use of the invention as a foundation vent.

A preferred embodiment of a foundation vent 20 of the present invention is illustrated in FIG. 1. Vent 20 is shown installed in a foundation wall 22 to provide ventilation to a crawl space 23 beneath a building 24. Vent 20 is comprised of two interlocking frames, a first frame 26 and a second frame 28. Preferably, first frame 26 is disposed facing the outside of foundation wall 22 and second frame 28 faces inside. Both frames 26, 28 slope outwardly slightly so that water entering the vent tends to run off rather than into the crawl space. In a preferred embodiment, vent 20 also includes breakaway rings 30.

Figure 2:
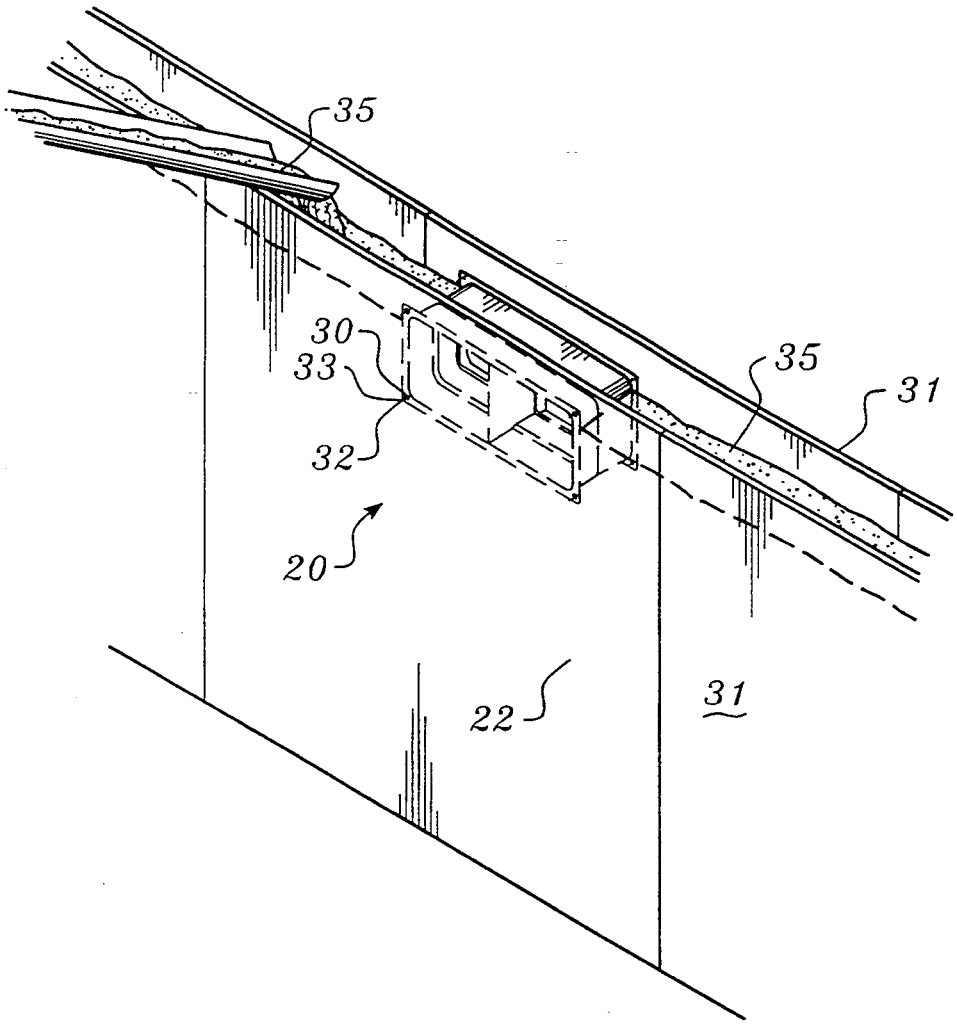
FIG. 2 is a perspective view of the invention, illustrating its use during the formation of the foundation walls.

Foundation vent 20 is used by locking frames 26, 28 together to form a desired width. As shown in FIG. 2, vent 20 is secured between forms 31 with nails 33 through breakaway rings 30 and into forms 31 in a desired location. Concrete 35 is poured between forms 31 and around vent 20 and is allowed to cure. Forms 31 are removed, along with weakened portions 32 (disposed behind nails in FIG. 2) of breakaway rings 30, thus leaving the concrete foundation wall 22 with foundation vent 20 mounted therein.

Since weakened portions 32 of breakaway rings 30 are removed with forms 31 and nail 33, breakaway rings 30 are illustrated without weakened portions 32 in FIG. 1. A more detailed discussion of breakaway rings 30 is made below in connection with FIGS. 9 and 10. Also note that other types of fasteners such as screws could be used instead of nails.

Figure 3:
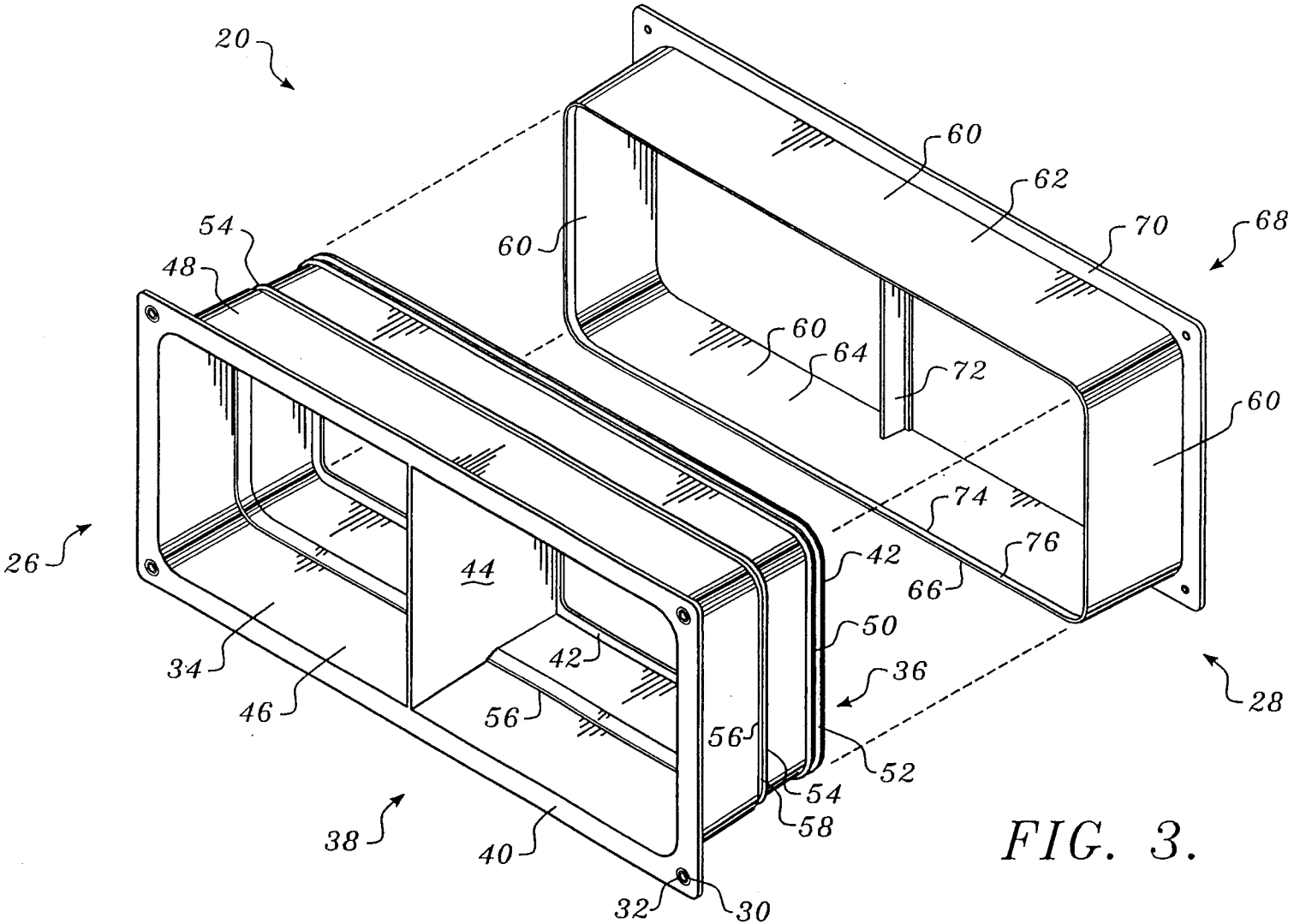
FIG. 3 is an exploded perspective view of the invention, illustrating the two frames that make up the foundation vent.
Figure 4:
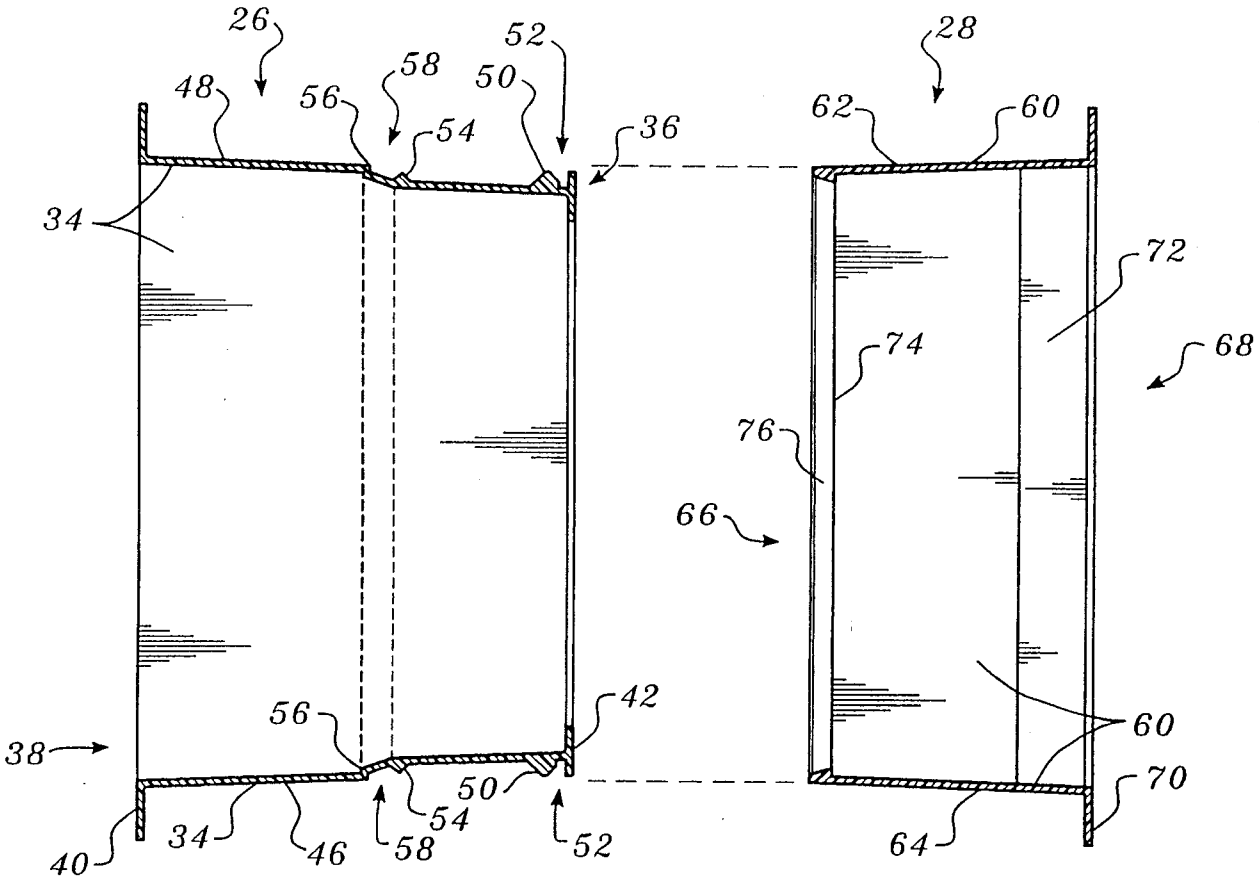
FIG. 4 is an exploded cross-sectional view of the invention, illustrating the configuration of the two-position locking system.

Further details of the invention are more clearly shown in FIGS. 3 and 4 (illustrating an exploded perspective view and an exploded cross-sectional view, respectively). As mentioned above, vent 20 includes first frame 26 and second frame 28. First frame 26 includes first walls 34 that, in a preferred embodiment, form a parallelepiped shape with a first inner end 36 and a first outer end 38. First walls 34 slope outwardly slightly from first inner end 36 to form a larger opening at first outer end 38. A first flange 40 extends outwardly around the perimeter of first outer end 38 in a plane generally transverse to the first walls of first frame 26. First flange 40 includes breakaway rings 30 disposed at each corner. A first inner flange 42 is disposed around the perimeter of first inner end 36, extending outwardly in a plane generally transverse to the first walls of first frame 26. First inner flange 42 also extends inwardly a distance sufficient to attach a screen and/or door (not shown). A wide partition 44 is disposed vertically in the middle of first frame 26, extending from first outer end 38 to first inner end 36 and from the middle of a first bottom wall 46 to the middle of a first top wall 48. First inner flange 42 also extends into the openings disposed along both sides of the edge of wide partition 44, at first inner end 36.

A first shoulder 50 is disposed adjacent and parallel to first inner flange 42 on an outside perimeter of first walls 34. A first channel 52 is defined between first inner flange 42 and first shoulder 50. A second shoulder 54 is disposed around an outside perimeter of first walls 34. Second shoulder 54 is preferably displaced from first inner flange 42 a distance of about two inches and runs around the outside of first walls 34 in a plane parallel to a first inner flange 42. Second shoulder 54 is followed by a step 56 in first walls 34 that runs around a perimeter of first walls 34 in a plane parallel to second shoulder 54. Step 56 is displaced from second shoulder 54 sufficiently to provide a second channel 58 on first frame 26.

Second frame 28 is also illustrated in FIGS. 3 and 4. Second frame 28 comprises second walls 60, including a top wall 62 and a bottom wall 64, a second inner end 66 and a second outer end 68. A second flange 70 surrounds second outer end 68, extending outwardly in a plane that is generally transverse to second walls 60. Second flange 70 also includes breakaway rings 30 disposed at its corners. A narrow partition 72 extends from the middle of bottom wall 64 to the middle of top wall 62 in a plane perpendicular to second flange 70. Preferably, the width of narrow partition 72 extends from second outer end 68 to approximately two inches from second inner end 66. Second flange 70 also runs along narrow partition 72 at second outer end 68.

A ridge 74 including a taper 76 is disposed along the inside perimeter of second inner end 66. Taper 76 begins at second inner end 66 and slopes inwardly to ridge 74. Ridge 74 is disposed in a plane parallel to second inner end 66. The width of taper 76 is substantially equal to a width of first and second channels 52, 58. The extent to which ridge 74 protrudes from second walls 60 is small enough such that ridge 74 substantially fits within first and second channels 52, 58.

Figure 5:
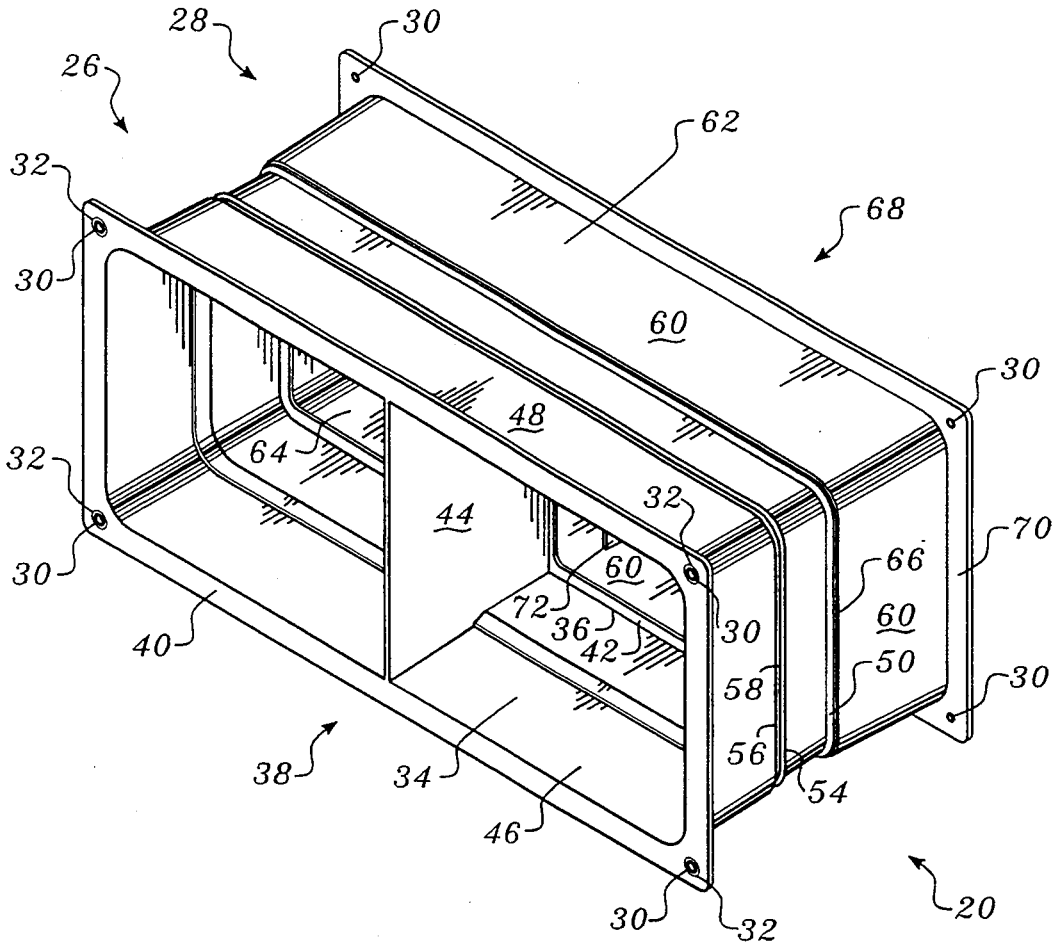
FIG. 5 is a perspective view of the invention, illustrating the frames locked together in a wide configuration.
Figure 6:
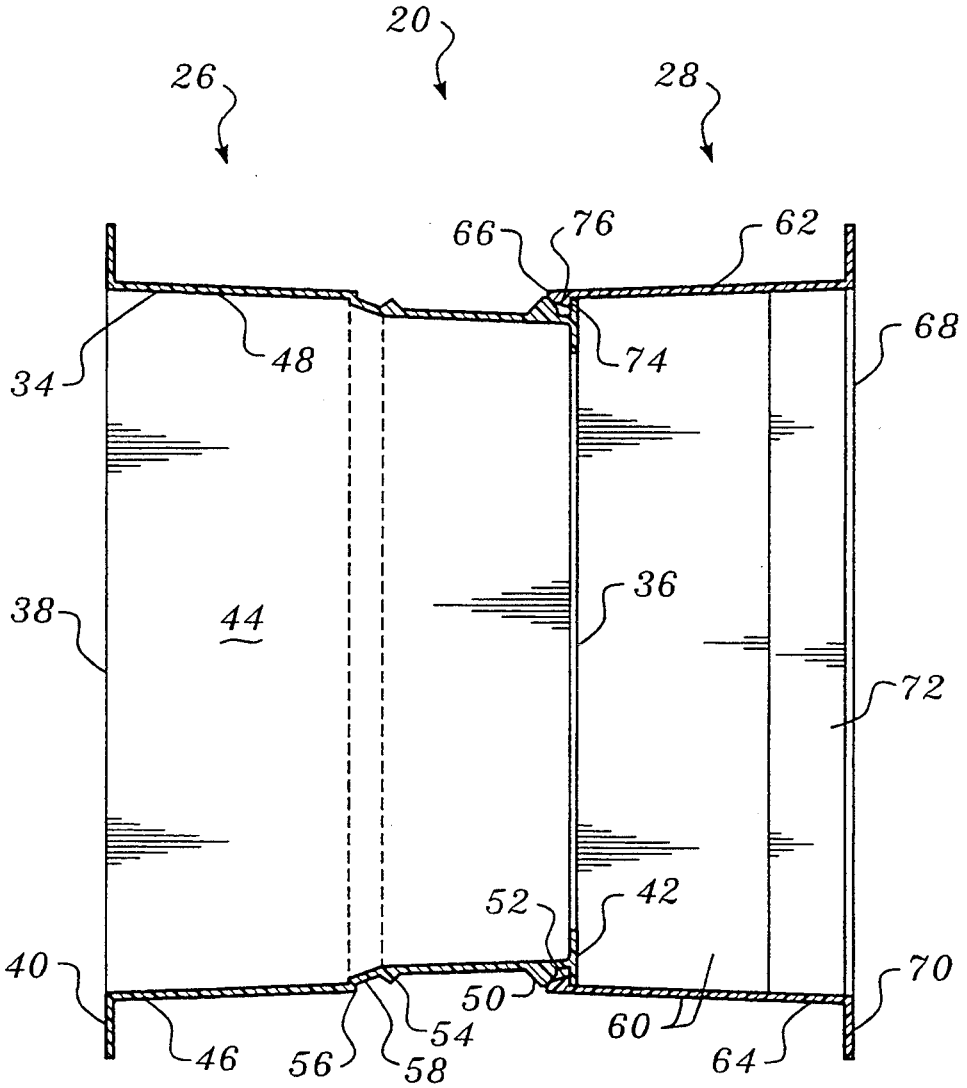
FIG. 6 is a cross-sectional view of the invention, illustrating the configuration shown in FIG. 5 with the frames interlocked in a wide position.

FIGS. 5 and 6 illustrate a wide configuration of vent 20 (showing a perspective view and a cross-sectional view, respectively). In the preferred embodiment, the width of vent 20 in this configuration is about eight inches, substantially matching the thickness of an eight-inch foundation wall. Vent 20 is locked in the wide configuration by positioning ridge 74 against first inner flange 42 so that ridge 74 and taper 76 are within and engage first channel 52. First shoulder 50 and first inner flange 42 keep ridge 74 within first channel 52.

Preferably, vent 20 is made of plastic and can elastically deflect to allow second frame 28 to be inserted over first frame 26. Taper 76 aids in deflecting second inner end 66 outwardly and first inner end 36 inwardly as flames 26, 28 are pushed together. However, because of a sharp drop from ridge 74 to second walls 58 and the vertical orientation of first inner flange 42, once second frame 28 is inserted over first frame 26, second frame 28 remains coupled to first frame 26 and is readily separated from the first frame.

Figure 7:
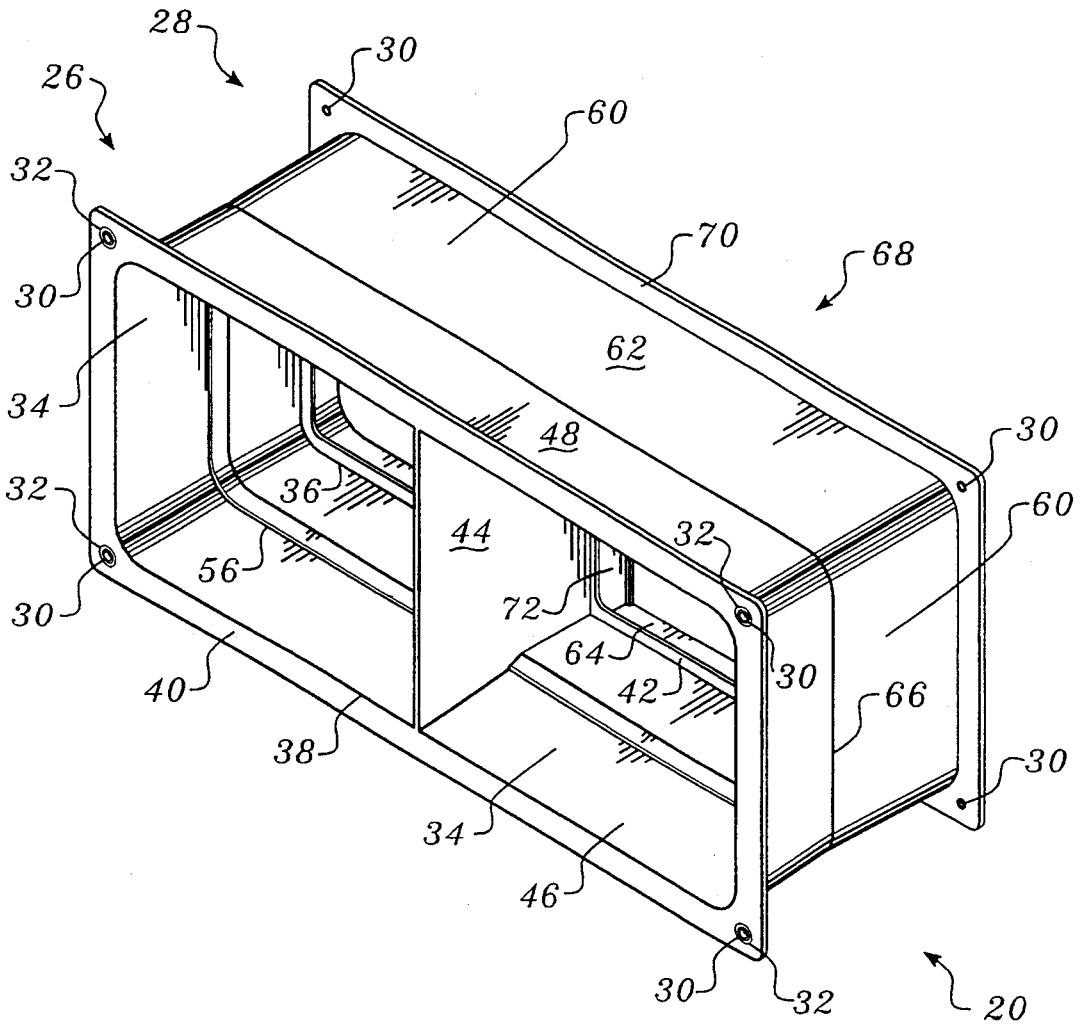
FIG. 7 is a perspective view of the invention, illustrating the frames locked together in a narrow configuration.
Figure 8:
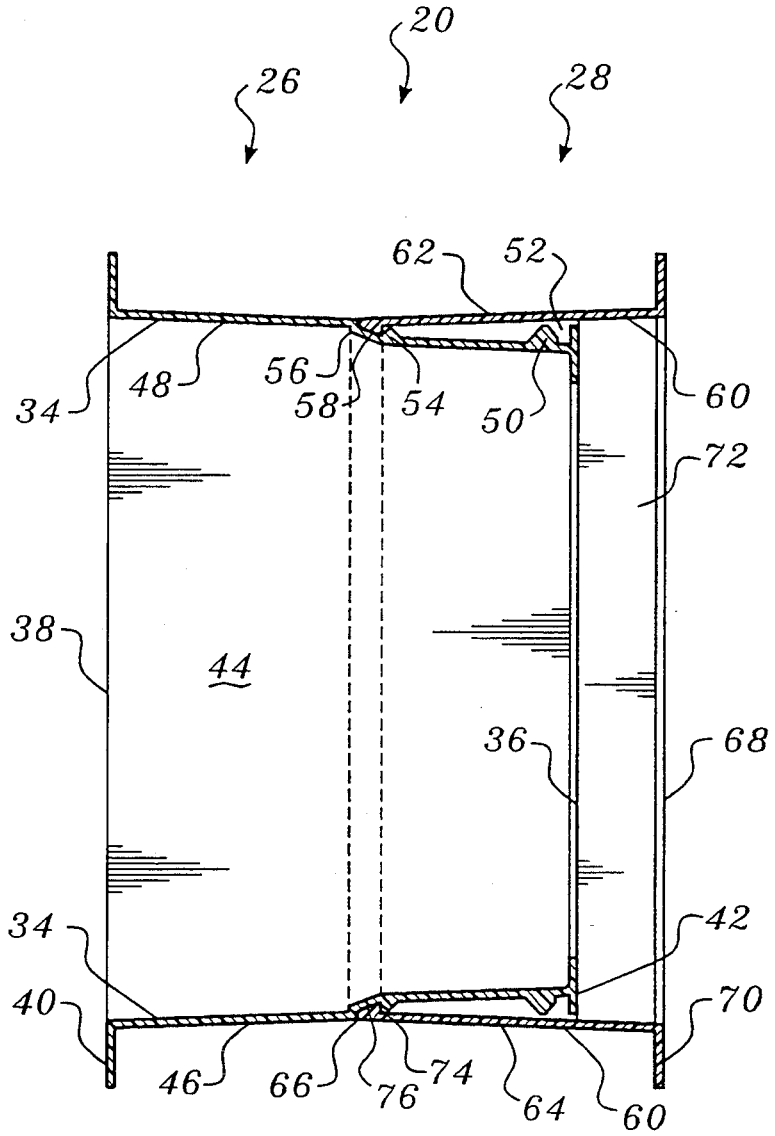
FIG. 8 is a cross-sectional view of the invention, illustrating the configuration shown in FIG. 7 with the frames interlocked in a narrow position.

FIGS. 7 and 8 illustrate a narrow configuration of vent 20 (showing a perspective view and a cross-sectional view, respectively). In the preferred embodiment, the width of vent 20 in this configuration is about six inches, substantially matching the thickness of a six-inch foundation wall. Vent 20 is locked in the narrow configuration by positioning second inner end 66 against step 56 so that ridge 74 and taper 76 are within and engage second channel 58. Step 56 and second shoulder 54 keep ridge 74 within second channel 58. In this configuration, narrow partition 72 abuts directly against wide partition 44. These partitions 44, 72 add structural strength to vent 20 that may be needed to resist its deformation as concrete is poured around the vent.

To assemble vent 20 in the narrow configuration, oppositely directed forces are applied to first outer end 38 and second outer end 68. Taper 76 and ridge 74 initially ride over first shoulder 50 and along first walls 34 to second shoulder 54. Taper 76 and ridge 74 then ride over second shoulder 54 until second inner end 66 abuts against step 56. Note that shoulders 50, 54 have sloped sides so that taper 76 and ridge 74 will more readily ride over shoulders 50, 54 under the application of a sufficient force as walls 34, 60 deflect slightly. Note also, however, that step 56 includes a vertical portion abutted directly against second inner end 66 so that the narrow configuration shown in FIGS. 7 and 8 represents the limit to which the two halves of vents can be forced together.

Figure 9:
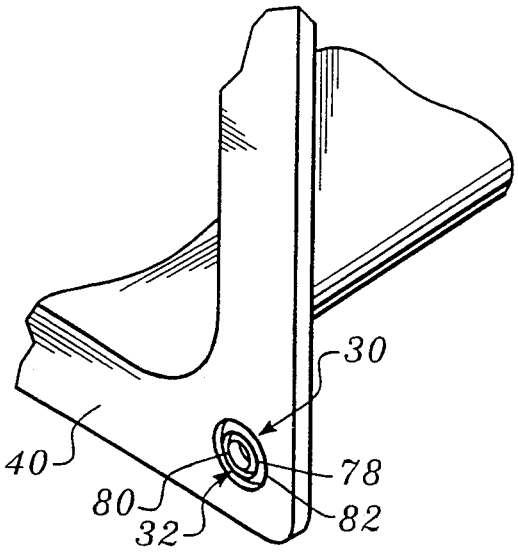
FIG. 9 is a perspective view of a cutaway portion of a frame corner, illustrating a preferred embodiment of a breakaway portion of the flanges.

FIG. 9 illustrates the detail of breakaway rings 30. Preferably, breakaway rings 30 include weakened portions 32 comprised of concentric grooves 78 formed around small holes 80, the grooves defining circular areas where the plastic is only about one-third as thick as the remainder of the flange so that it is easily separated. The diameter of small holes 80 is large enough to permit a nail shaft (or other fastener) to pass through easily, but small enough stop a nail head (or the head of another fastener) from passing through.

In use, fasteners are passed through small holes 80 to secure vent 20 while the concrete is poured, formed, and cured. Once the concrete is cured, forms 31 are removed. Removal of the forms causes the fastener heads to break weakened portion 32 from breakaway rings 30 at the bottom of concentric grooves 78, leaving large holes 82. The diameter of large holes 82 is large enough to permit the fastener heads to pass through easily. Thus, vent 20 is left in foundation wall 22 without weakened portions 32.

Figure 10:
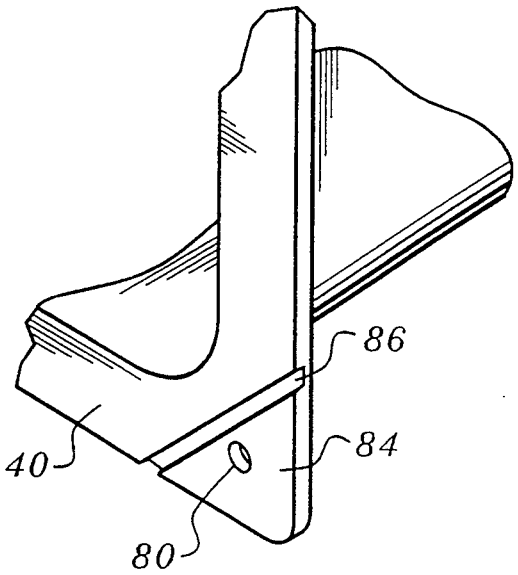
FIG. 10 is a perspective view of a cutaway portion of a frame corner, illustrating an alternate embodiment of a breakaway portion of the flanges.

An alternate embodiment is illustrated in FIG. 10. A breakaway tab 84 is provided that is defined by a weakened channel 86 that runs diagonally across corners of flanges 40, 70. Small holes 80 are provided for securing vent 20 to the forms. When the forms are removed, breakaway tabs 84 readily separate or tear away from flanges 40, 70 leaving vent 20 mounted in foundation wall 22.

While the preferred embodiment of the invention has been illustrated and described, it will be appreciated that various changes can be made therein without departing from the spirit and scope of the invention. For example, three or more channels could be disposed along the outside perimeter of first walls 34 creating three or more positions in which to lock the first and second sections of vent 20 to accommodate three or more different concrete wall thicknesses. Another possible change may be disposing shoulders that define channels on the inside of second frame 28, with first frame 26 having one or multiple ridges to interlock in the channels.

The embodiments of the invention in which an exclusive property or privilege is claimed are defined as follows:

1. Apparatus for creating an opening when forming concrete with forms, said apparatus being adjustable to accommodate a plurality of concrete thicknesses, comprising:

(a) a first frame comprising:

(i) a first hollow body having a first inner end and a first outer end, said first hollow body having forming walls for contacting and retaining concrete to create a portion of the opening;

(ii) a first flange surrounding said first outer end, said first flange including first means for attachment to the forms, said first means for attachment including a first breakaway section of said first flange, said first breakaway section having an ability to hold said first frame in place to form the concrete but being sufficiently weakened so that, when the forms are pulled away, said first breakaway section breaks off said first flange without damaging other areas of said first flange, said first breakaway section comprising an annular groove immediately adjacent an area of attachment of said first flange to the forms; and (iii) at least one shoulder circumscribing an exterior surface of said first hollow body; and (b) a second frame comprising:

(i) a second hollow body having a second inner end and a second outer end, said second inner end having a perimeter larger than the perimeter of said first inner end of said first hollow body;

(ii) a second flange surrounding said second outer end, said second flange including second means for attachment to the forms, said second means for attachment including a second breakaway section of said second flange, said second breakaway section having an ability to hold said second frame in place to form the concrete but being sufficiently weakened so that, when the forms are pulled away, said second breakaway section breaks off said second flange without damaging other areas of said second flange, wherein said second breakaway section comprises an annular groove immediately adjacent an area of attachment of said second flange to the forms; and (iii) at least one ridge around the inside of said second hollow body, said at least one ridge being shaped to engage said at least one shoulder of said first frame as said second inner end of said second frame is telescoped over said first inner end of said first frame.

2. Apparatus for creating an opening when forming concrete with forms, said apparatus being adjustable to accommodate a plurality of concrete thicknesses, comprising:

(a) a first frame comprising:

(i) a first hollow body having a first inner end and a first outer end, said first hollow body having forming walls for contacting and retaining concrete to create a portion of the opening;

(ii) a first flange surrounding said first outer end, said first flange including first means for attachment to the forms; and (iii) at least one shoulder circumscribing an exterior surface of said first hollow body; and (b) a second frame comprising:

(i) a second hollow body having a second inner end and a second outer end, said second inner end having a perimeter larger than the perimeter of said first inner end of said first hollow body;

(ii) a second flange surrounding said second outer end, said second flange including second means for attachment to the forms; and (iii) at least one ridge around the inside of said second hollow body, said at least one ridge being shaped to engage said at least one shoulder of said first frame as said second inner end of said second frame is telescoped over said first inner end of said first frame;

wherein said first means for attachment and said second means for attachment comprise breakaway sections including weakened tabs defined by grooves within said first flange and said second flange, respectively, said breakaway sections having an ability to hold said first frame and said second frame in place to form the concrete but being sufficiently weakened so that, when the forms are pulled away, said breakaway sections break off said first flange and said second flange without damaging other areas of said flanges.

3. Apparatus for creating an opening when forming concrete with forms, said apparatus being adjustable to accommodate a plurality of concrete thicknesses, comprising:

(a) a first frame comprising:

(i) a first hollow body having a first inner end and a first outer end, said first hollow body having forming walls for contacting and retaining concrete to create a portion of the opening;

(ii) a first flange surrounding said first outer end, said first flange including first means for attachment to the forms; and (iii) a plurality of shoulders circumscribing an exterior surface of said first hollow body, said shoulders forming at least one channel around said first hollow body; and (b) a second frame comprising:

(i) a second hollow body having a second inner end and a second outer end, said second inner end having a perimeter larger than the perimeter of said first inner end of said first hollow body;

(ii) a second flange surrounding said second outer end, said second flange including second means for attachment to the forms; and (iii) at least one ridge around the inside of said second hollow body, said at least one ridge being shaped to engage said at least one channel of said first frame as said second inner end of said second frame is telescoped over said first inner end of said first frame for allowing engagement of said first frame and said second frame together in at least one predetermined width.

4. Apparatus for creating an opening when forming concrete with forms, said apparatus being adjustable to accommodate a plurality of concrete thicknesses, comprising:

(a) a first frame comprising:

(i) a first hollow body having a first inner end and a first outer end;

(ii) a first flange surrounding said first outer end, said first flange including first means for attachment to the forms, said first means comprising at least one weakened tab defined by at least one groove within said first flange, said tab having an ability to hold said first frame in place to form the concrete but being sufficiently weakened so that, when the forms are pulled away, said tab breaks from said first flange without damaging other areas of said first flange; and (iii) at least one shoulder circumscribing an exterior surface of said first hollow body; and (b) a second frame comprising:

(i) a second hollow body having a second inner end and a second outer end, said second inner end having a perimeter larger than the perimeter of said first inner end of said first hollow body;

(ii) a second flange surrounding said second outer end, said second flange including second means for attachment to the forms, said second means comprising at least one weakened tab defined by at least one groove within said second flange, said tab having an ability to hold said second frame in place to form the concrete but being sufficiently weakened so that, when the forms are pulled away, said tab breaks from said second flange without damaging other areas of said second flange; and (iii) at least one ridge around the inside of said second hollow body, said at least one ridge being shaped to engage said at least one shoulder of said first frame as said second inner end of said second frame is telescoped over said first inner end of said first frame.

5. Apparatus for creating an opening when forming concrete with forms, said apparatus being adjustable to accommodate a plurality of concrete thicknesses, comprising:

(a) a first frame comprising:

(i) a first hollow body having a first inner end and a first outer end;

(ii) a first flange surrounding said first outer end, said first flange including first means for attachment to the forms; and (iii) a plurality of shoulders that form at least one channel around said first hollow body; and (b) a second frame comprising:

(i) a second hollow body having a second inner end and a second outer end, said second inner end having a perimeter larger than the perimeter of said first inner end of said first hollow body;

(ii) a second flange surrounding said second outer end, said second flange including second means for attachment to the forms; and (iii) at least one ridge around the inside of said second hollow body, said at least one ridge being shaped to engage said shoulders of said first frame as said second inner end of said second frame is telescoped over said first inner end of said first frame, said at least one channel being formed to receive said at least one ridge for allowing engagement of said first frame and said second frame together in at least one predetermined width.

6. The apparatus of claim 5, wherein said first frame and said second frame have parallelepiped shapes; said at least one ridge being disposed at said inner end of said second frame; said first frame further comprising a plurality of channels around said first hollow body, said channels being offset from each other along the width of said first frame; and wherein said first hollow body slopes outwardly from said first inner end to said first outer end and said second hollow body slopes outwardly from said second inner end to said second outer end.

7. A foundation vent to be used when forming concrete with forms, said foundation vent comprising:

(a) a first frame including a first rigid body having a plurality of first walls, a first inner end, and a first outer end, said first frame further including a first flange around a perimeter of said first outer end;

(b) a second frame including a second rigid body having a plurality of second walls, a second inner end, and a second outer end, said second frame further including a second flange around a perimeter of said second outer end; and (c) means for engaging said first frame with said second frame in a plurality of telescoping positions such that said foundation vent can be adjusted to match a thickness of the concrete, wherein said means for engaging comprise at least one ridge disposed around a perimeter of said second inner end of said second frame and a plurality of shoulders forming a plurality of channels around said first walls of said first frame, wherein said at least one ridge engages successive ones of said plurality of channels as the first and second frames are forced together in telescoping relationship to each other.

8. A method for creating a foundation vent within a concrete foundation wall while forming the foundation wall with forms, comprising the steps of:

(a) providing a vent structure having two frames that are adapted to interlock in a telescoping fashion to fit a plurality of foundation wall thicknesses;

(b) locking said vent structure to fit a desired thickness of the concrete foundation;

(c) securing said vent structure in a desired location between the forms, including the step of inserting fasteners within breakaway sections of at least one of said frames and into the forms, thereby attaching the breakaway sections to the forms;

(d) pouring concrete between the forms such that the concrete at least partially surrounds said vent structure;

(e) allowing said concrete to cure; and (f) removing the forms with said breakaway sections remaining attached to the forms, said breakaway sections being separated from said vent structure, leaving said vent structure mounted within the foundation wall.

* * * * *